US009989984B2

(12) United States Patent
Tseng et al.

(10) Patent No.: US 9,989,984 B2
(45) Date of Patent: Jun. 5, 2018

(54) REFERENCE VOLTAGE CIRCUIT

(71) Applicant: NUVOTON TECHNOLOGY CORPORATION, Hsinchu (TW)

(72) Inventors: Te-Ming Tseng, Hsin-chu Science Park (TW); Wei-Chan Hsu, Cupertino, CA (US); Yeh-Tai Hung, Hsin-chu Science Park (TW); Wen-Yi Li, Hsin-chu Science Park (TW)

(73) Assignee: NUVOTON TECHNOLOGY CORPORATION, Hsinchu (TW)

( * ) Notice: Subject to any disclaimer, the term of this patent is extended or adjusted under 35 U.S.C. 154(b) by 23 days.

(21) Appl. No.: 15/398,004

(22) Filed: Jan. 4, 2017

(65) Prior Publication Data

US 2017/0199540 A1 Jul. 13, 2017

(30) Foreign Application Priority Data

Jan. 12, 2016 (TW) ..... 105100761 A

(51) Int. Cl.
*G05F 1/10* (2006.01)
*G05F 3/24* (2006.01)

(52) U.S. Cl.
CPC ..... *G05F 3/24* (2013.01)

(58) Field of Classification Search
CPC . G05F 3/24; G05F 3/242; G05F 3/245; G05F 3/247; G05F 1/10; G05F 1/12; G05F 1/13; G05F 1/14; G05F 1/147; G05F 1/153; G05F 1/16; G05F 1/20; G05F 1/22; G05F 1/24; G05F 1/247; G05F 1/25326; G05F 1/30; H03K 3/011; H03K 3/023; H03K 3/0231; H01L 29/66992
USPC ..... 327/539
See application file for complete search history.

(56) References Cited

U.S. PATENT DOCUMENTS 6,052,035 A * 4/2000 Nolan ..... H03K 3/011 331/111
8,030,977 B2 * 10/2011 Ooyagi ..... H03K 4/502 327/141
2004/0212421 A1 * 10/2004 Naka ..... G05F 3/242 327/541
2009/0121701 A1 * 5/2009 Kim ..... G05F 3/30 323/313

* cited by examiner

*Primary Examiner* — Patrick Chen
(74) *Attorney, Agent, or Firm* — Muncy, Geissler, Olds & Lowe, P.C.

(57) ABSTRACT

A reference voltage circuit is provided, which includes bandgap reference circuit, bias current generator, first capacitor, second capacitor, comparator and control logic circuit. In the active mode of the control logic circuit, the control logic circuit controls the bandgap reference circuit to deliver bandgap reference voltage. The comparator transmits first comparison signal to control logic circuit when the first and second capacitors are charged to the bandgap reference voltage. The control logic circuit enters low power mode and controls the bandgap reference circuit to stop delivering the bandgap reference voltage. If the comparator detects the potential difference between the first capacitor and second capacitor exceeds the threshold value, the control logic circuit returns to active mode according to the second comparison signal transmitted form the comparator.

11 Claims, 8 Drawing Sheets

REFERENCE VOLTAGE CIRCUIT

CROSS-REFERENCE TO RELATED APPLICATION

This application claims priority from the Taiwan Patent Application No. 105100761, filed on 12 Jan. 2016, in the Taiwan Intellectual Property Office, the content of which is hereby incorporated by reference in its entirety for all purposes.

BACKGROUND OF THE INVENTION

1. Field of the Invention

The present disclosure relates to a reference voltage circuit. More particularly, the present disclosure relates to a reference voltage circuit having ultra-low power consumption and automatic on/off function; by detecting the offset between the reference voltage and the replicated voltage and transmitting the detection results back to the control logic circuit, the automatic on/off function of the reference voltage circuit is achieved.

2. Description of the Related Art

Nowadays, Microcontroller Unit (MCU) has been widely applied in many fields, and many designers in the Information Technology industry have embarked on the quest to design a MCU with low power consumption. For instance, when the MCU is applied in the intelligent water meter, it is a pressing issue to bring the power consumption of the MCU down in order to extend the battery life of the intelligent water meter.

An accurate reference voltage circuit is a very important element for the MCU; such reference voltage circuit should have characteristics including zero temperature coefficient, process drift resistance, not being affected by the variation in voltage source, etc. In addition to providing reference voltage to the Analog to Digital Converter (ADC) or the comparator, the reference voltage circuit serves as the reference for the power management circuit of the MCU. A high quality reference voltage circuit is the key to an excellent power management circuit, conventional reference voltage circuits with low power consumption design commonly found in the market are plagued with problems such as poor precision, excessive temperature coefficient, etc.

Besides, in a low power consumption system, the applied reference voltage (Vref or VBG) is usually generated by a bandgap reference circuit with low power consumption. Such bandgap reference circuit is of poor quality despite consuming less power. For instance, the bandgap reference circuit of poor quality might suffer from poor temperature compensation or the generated reference voltage might vary too much.

SUMMARY OF THE INVENTION

In light of the aforementioned technical issues, the present disclosure provides a reference voltage circuit including a bandgap reference circuit, a bias current generator, a first capacitor, a second capacitor, a comparator and a control logic circuit. The bandgap reference circuit is connected to a first switch and a second switch and configured to provide a bandgap reference voltage. The bias current generator is connected to the bandgap reference circuit. The first capacitor is connected between the first switch and the ground terminal. The second capacitor is connected between the second switch and another ground terminal. The comparator has a first input terminal and a second input terminal respectively connected to the first capacitor and the second capacitor to compare a voltage difference between the first capacitor and the second capacitor. The bias current generator is connected to a power supply terminal of the comparator. The control logic circuit is connected between the comparator and the first switch, and connected between the second switch and the bandgap reference circuit. In the active mode of the control logic circuit, the control logic circuit controls the first switch and the second switch to turn on, and controls the bandgap reference circuit to provide the bandgap reference voltage to charge the first capacitor and the second capacitor. When the voltages in the first capacitor and the second capacitor reach the bandgap reference voltage, the comparator transmits a first comparison signal to the control logic circuit, such that the control logic circuit enters the low power mode. In the low power mode, the control logic circuit controls the first switch and the second switch to turn off, and controls the bandgap reference circuit to stop providing the bandgap reference voltage. Then, the first capacitor and the second capacitor start discharging. When the voltage difference between the first capacitor and the second capacitor is larger than a threshold value of the comparator, the comparator transmits a second comparison signal, the control logic circuit returns to the active mode according to the second comparison signal. The voltage changing rates of the first capacitor and the second capacitor are not equal during charging and discharging.

Preferably, the reference voltage circuit further includes a third switch connected between the bandgap reference circuit and both the first and second switches. The control logic circuit is connected to the third switch and controls the third switch. In the active mode, the control logic circuit controls the third switch to turn on according to the first comparison signal; in the low power mode, the control logic circuit controls the third switch to turn off according to the second comparison signal.

Preferably, the reference voltage circuit further includes a fourth switch connected between the bias current generator and both the first and the second switches. The control logic circuit is connected to the fourth switch and controls the fourth switch. In the active mode, the control logic circuit controls the fourth switch to turn off; in the low power mode, the control logic circuit controls the fourth switch to turn on according to the second comparison signal.

Preferably, the reference voltage circuit further includes a source follower connected between the fourth switch and the bias current generator. The first input terminal of the source follower is connected to the second capacitor while the second input terminal of the source follower is connected to the bias current generator in order to reduce the leakage current passing through the first switch and the second switch in the low power mode.

Preferably, the first switch is a first transistor. In the active mode, the control logic circuit controls the body electrode of the first transistor to selectively connect to the source electrode of the first transistor according to the first comparison signal, in the low power mode, the control logic circuit controls the body electrode of the first transistor to selectively connect to a voltage source according to the second comparison signal.

Preferably, the second switch is a second transistor. In the active mode, the control logic circuit controls the body electrode of the second transistor to selectively connect to the source electrode of the second transistor according to the first comparison signal, in the low power mode, the control logic circuit controls the body electrode of the second transistor to selectively connect to a voltage source according to the second comparison signal.

Preferably, the reference voltage circuit further includes a buffer connected between the bandgap reference circuit and the third switch.

Preferably, the reference voltage circuit further includes a Schmitt trigger disposed between the output terminal of the comparator and the input terminal of the control logic circuit.

Preferably, the discharging rate of the first capacitor is not equal to a discharging rate of the second capacitor.

Preferably, the capacitance of the first capacitor is equal to the capacitance of the second capacitor, and the current flowing into or flowing out of the first capacitor is not equal to the current flowing into or flowing out of the second capacitor.

Preferably, the capacitance of the first capacitor is not equal to the capacitance of the second capacitor while the current flowing into or flowing out of the first capacitor is not equal to the current flowing into or flowing out of the second capacitor.

In conclusion, the reference voltage circuit of the present disclosure stores the high precision bandgap reference voltage generated from the bandgap reference circuit to the capacitors, and uses effective control mechanism (turn-on/off of the bandgap reference circuit) to repeatedly recharge the capacitors and, so as to ensure that the reference voltages stored in the capacitors are consistent with the bandgap reference voltage generated by the bandgap reference circuit. By means of the control mechanism, the reference voltage circuit of present disclosure is automatically self-adjustable according to the variation of temperature, process and voltage. Henceforth, the reference voltage circuit of present disclosure can achieve effects of high precision and low power consumption both.

BRIEF DESCRIPTION OF THE DRAWINGS

Various features and advantages of the present invention will be thoroughly understood through the exemplary embodiments with reference to the accompanying drawings, wherein.

DESCRIPTION OF THE PREFERRED EMBODIMENTS

The present disclosure has been described with some preferred embodiments thereof and it is understood that many changes and modifications in the described embodiments can be carried out without departing from the scope and the spirit of the invention that is intended to be limited only by the appended claims.

Figure 1:
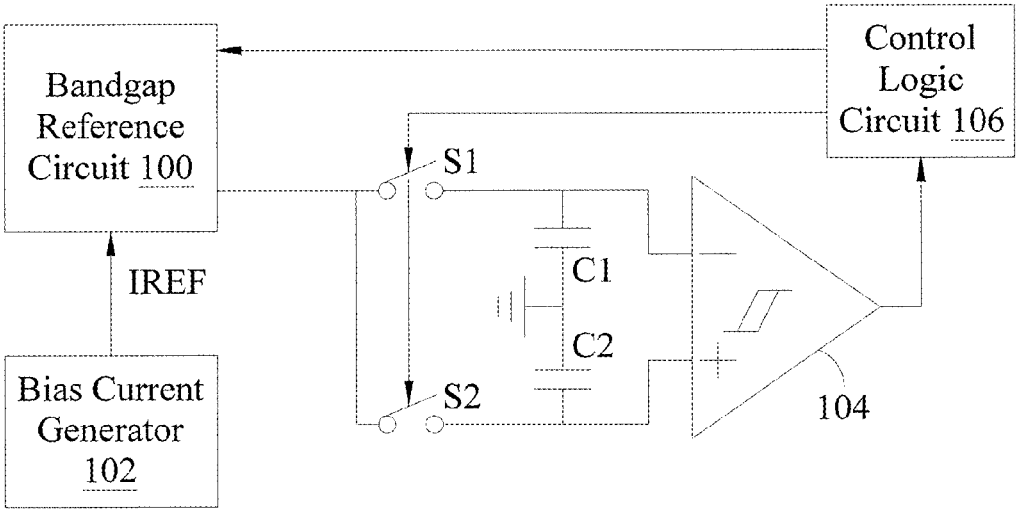
FIG. 1 is the schematic diagram illustrating the reference voltage circuit according to the first embodiment of the present disclosure.

Refer to the FIG. 1, which is a schematic diagram illustrating the reference voltage circuit according to the first embodiment of the present invention. As can be appreciated in the figure, the reference voltage circuit includes a bandgap reference circuit 100, a bias current generator 102, a first capacitor C1, a second capacitor C2, a comparator 104 and a control logic circuit 106. The bandgap reference circuit 100 is connected to the first switch S1 and the second switch S2, as well as capable of delivering the bandgap reference voltage VBG1. The bias current generator 102 is connected to the bandgap reference circuit 100. The first terminal of the first capacitor C1 is connected to the first switch S1 whereas the second terminal thereof is connected to the ground terminal GND. The first terminal of the second capacitor C2 is connected to the second switch S2 whereas the second terminal thereof is connected to another ground terminal GND, whereas the capacitance of the second capacitor C2 is higher than the capacitance of the first capacitor C1.

The comparator 104 is respectively connected to the first terminal of the first capacitor C1 and the first terminal of the second capacitor C2 to compare the potential difference between the first terminals of the first capacitor C1 and second capacitor C2, whereas the bias current generator 102 is connected to a power supply terminal of the comparator 104. The bias current generator 102 can be a constant transconductance bias circuit (constant-gm bias circuit) which provides a bias current to the comparator 104 and the bandgap reference circuit 100. Preferably, the bias current generator 102 includes a plurality of output terminals that are capable of providing a plurality of constant currents of different magnitudes, for instance, the bias current generator 102 may be capable of providing constant current of 10 nA, 25 nA, 50 nA or 75 nA.

The control logic circuit 106 is electrically connected between the comparator 104 and the first switch S1 and between the bandgap reference circuit 100 and the second switch S2. In particular, the control logic circuit 106 is connected to the output terminal of the comparator 104, the control terminal of the first switch S1 and the control terminal of the second switch S2. The control logic circuit 106 is also electrically connected to the bandgap reference circuit 100.

Figure 2A:
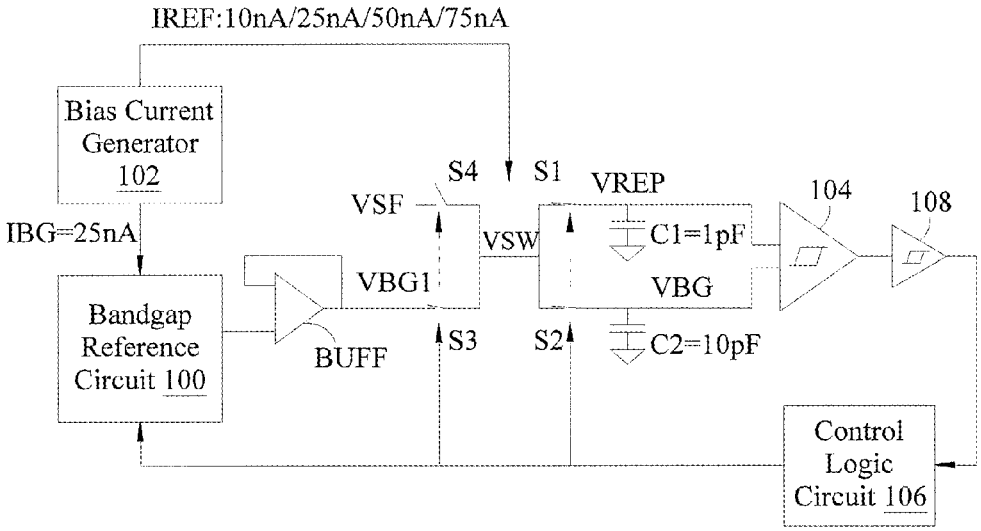
FIGS. 2A and 2B are the schematic diagrams illustrating the circuit layout of the reference voltage circuit in the active mode and the low power mode according to the second embodiment of the present disclosure.
Figure 2B:
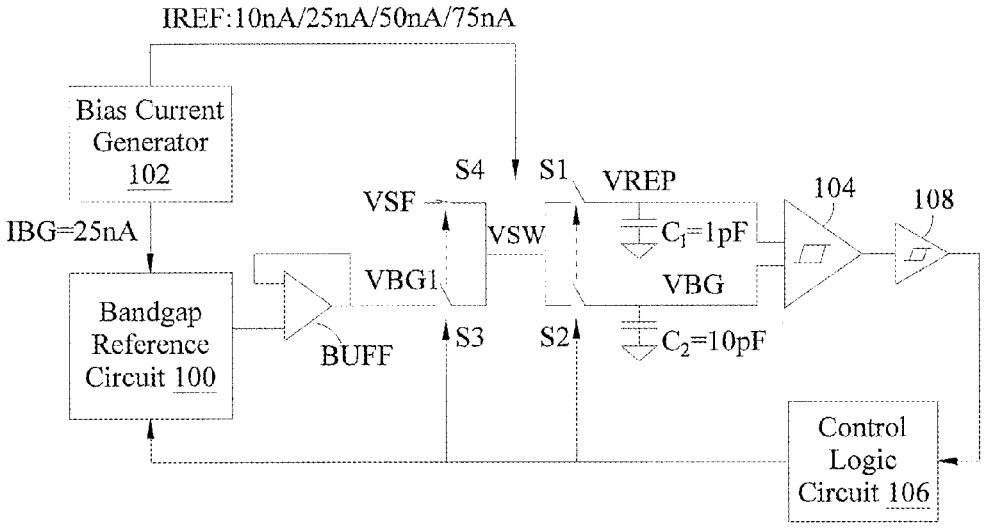

Refer to the FIGS. 2A and 2B which are the schematic diagrams illustrating the circuit layout of the reference voltage circuit in the active mode and the low power mode according to the second embodiment of the present invention. The control logic circuit 106 of the present invention operates in the active mode or the low power mode. When the present invention is activated, the control logic circuit 106 will be in the active mode initially. The control logic circuit 106 controls the bandgap reference circuit 100 to deliver bandgap reference voltage VBG1, as well as control the first switch S1 and the second switch S2 to turn on. Under the circumstances, the electric potential VREP at the first terminal of the first capacitor C1 and the electric potential VBG at the first terminal of the second capacitor C2 will be charged to the bandgap reference voltage VBG1; when the electric potentials VREP and VBG at the first terminals of the first and second capacitors C1 and second capacitor C2 reach the bandgap reference voltage VBG1, the comparator 104 determines the potential difference between the two terminals as 0, then transmits the first comparison signal to the control logic circuit 106 which subsequently enters the low power mode. In the meantime, the electric potential VBG at the first terminal of the second capacitor C2 can act as the reference voltage for the power management circuitry.

In the low power mode, the control logic circuit 106 turns off the first switch S1 and second switch S2, and controls the bandgap reference circuit 100 to stop delivering the bandgap reference voltage VBG1. In an ideal condition, the electric potential at the first terminal of the first capacitor C1 and the second capacitor C2 is able to maintain at bandgap reference voltage VBG1. However, since the first switch S1 and second switch S2 are usually P type Metal-Oxide-Semiconductor Field-Effect Transistors (MOSFET) instead of the ideal switches, so there is a minor current leakage even if the first switch S1 and second switch S2 are turned off. Therefore, in the low power mode, the first capacitor C1 and second capacitor C2 may discharge through the first switch S1 and the second switch S2 respectively; as a result, the loss of charge in the first capacitor C1 and second capacitor C2 may cause the electric potentials VREP and VBD to drift from the VBG1 supplied by the bandgap reference circuit 100.

In order to detect such current leakage, the capacitances of the first capacitor C1 and the second capacitor C2 of the present disclosure are configured such that the control logic circuit 106 is able to transmit control signals corresponding to the variation in the electric potential VREP and electric potential VBG. In this embodiment, the capacitance of the first capacitor C1 is smaller than that of the second capacitor C2, while both capacitors C1 and 2 have the equal discharge current, $I_{DISCHARGE}$. The variation in capacitance may be represented by Equation (1):

$$C = \frac{\Delta Q}{\Delta V} = I_{DISCHARGE} * T_{DISCHARGE} / \Delta V \quad (1)$$

When the comparator 104 detects that the potential difference between the first terminals of the first capacitor C1 and the second capacitor C2 exceeds the threshold value thereof, the comparator 104 transmits the second comparison signal and the control logic circuit 106 returns to the active mode according to the second comparison signal.

According to the preferred embodiment of the present invention, the capacitance of second capacitor C2 is set as 10 times the capacitance of the first capacitor C1, that is, C2=10*C1, it is apparent from the Equation (1) that the rate of voltage drop for the first capacitor C1 is 10 times faster than that of the second capacitor C2, i.e. ΔVREP=10ΔVBG for the same discharge period. Therefore, the difference between the voltages VBG and VREP can be detected with the configuration of hysteresis voltage of the comparator 104; once the voltage difference between the VBG and VREP exceeds the threshold value of the comparator 104, the bandgap reference circuit 100 will be turned on, in order to recharge the voltage inside the first capacitor C1 and the second capacitor C2 by delivering the bandgap reference voltage VBG1 thereto. As a result, the bandgap reference circuit 100 is configured to be turned on momentarily while staying off for most of the time, thereby substantially reducing the average power consumption of the present disclosure. in this embodiment, the ratio of duration the bandgap reference circuit 100 stays on to the duration the bandgap reference circuit 100 stays off may be configured to 1:1000. More precisely, if the power consumption of the bandgap reference circuit 100 is about 30 μA, with the aforementioned configuration, the duration the bandgap reference circuit 100 stays on may be 1 unit time whereas the duration thereof stays off may be 1000 unit time; so the average power consumption of the bandgap reference circuit 100 is merely 30 μA/1000=30 nA; thereby significantly reducing the power consumption of the bandgap reference circuit 100 while without sacrificing the functionality thereof.

In addition, in low power mode, if the capacitance of the first capacitor C1 and the second capacitor C2 is the same while the discharge current $I_{DISCHARGE}$ of first capacitor C1 is 10 times larger than that of the second capacitor C2, similar effect could be achieved. As can be appreciated from the Equation (1), the rate of voltage drop for the C1 will be 10 times faster than that of the second capacitor C2, i.e. ΔVREP=10ΔVBG for the same discharge period. Therefore, the difference between the voltages VBG and VREP can be detected with the configuration of hysteresis voltage of the comparator 104; once the voltage difference between the VBG and VREP exceeds the threshold value of the comparator 104, the bandgap reference circuit 100 will be turned on, in order to recharge the voltage inside the first capacitor C1 and the second capacitor C2 by delivering the bandgap reference voltage VBG1 thereto.

The present disclosure is not limited to the aforementioned embodiments. For instance, in another preferred embodiment, if the capacitance of the second capacitor C2 is twice larger than that of the first capacitor C1 while the discharge current of the first capacitor C1 is 5 times larger than that of the second capacitor C2, similar effect could be achieved as well. Similarly, from the Equation (1), the rate of voltage drop for the first capacitor C1 will be 10 times faster than that of the second capacitor C2, i.e. ΔVREP=10ΔVBG for the same discharge period. Therefore, the difference between the voltages VBG and VREP can be detected with the configuration of hysteresis voltage of the comparator 104; once the voltage difference between the VBG and VREP exceeds the threshold value of the comparator 104, the bandgap reference circuit 100 will be turned on, in order to recharge the voltage inside the first capacitor C1 and the second capacitor C2 by delivering the bandgap reference voltage VBG1 thereto.

In yet another embodiment of the present disclosure, in low power mode, if the capacitance of the second capacitor C2 is 5 times larger than that of the first capacitor C1 while the discharge current of the first capacitor C1 is twice larger than that of the second capacitor C2, similar effect could be achieved as well. Similarly, from the Equation (1), the rate of voltage drop for the first capacitor C1 will be 10 times faster than that of the second capacitor C2, i.e. ΔVREP=10ΔVBG for the same discharge period. Therefore, the difference between the voltages VBG and VREP can be detected with the configuration of hysteresis voltage of the comparator 104; once the voltage difference between the VBG and VREP exceeds the threshold value of the comparator 104, the bandgap reference circuit 100 will be turned on, in order to recharge the voltage inside the first capacitor C1 and the second capacitor C2 by delivering the bandgap reference voltage VBG1 thereto.

In addition, the reference voltage circuit of the present disclosure may further include a third switch S3 connected between the bandgap reference circuit 100 and the both of the first switch S1 and second switch S2, whereas the control logic circuit 106 is connected to the third switch S3 to control the third switch S3. In the active mode, the control logic circuit 106 controls the third switch S3 to turn on according to the first comparison signal; in the low power mode, the control logic circuit 106 controls the third switch S3 to turn off according the second comparison signal.

Furthermore, the reference voltage circuit may include a fourth switch S4 connected to the bias current generator 102 and both of the first switch S1 and second switch S2, whereas the control logic circuit 106 is connected to the fourth switch S4 to control the fourth switch S4. In the active mode, the control logic circuit 106 controls the fourth switch S4 to turn off according to the first comparison signal; in the low power mode, the control logic circuit 106 controls the fourth switch S4 to turn on according the second comparison signal. Under this condition, the bias current generator 102 delivers a reference current IREF to one terminal of the fourth switch S4 to generate an electric potential VSF, so as to reduce the potential difference between the first switch S1 and the second switch S2, the details will be given in the context below.

As shown in the FIGS. 2A to 2B, the bandgap reference circuit 100 further includes a buffer BUFF connected between the bandgap reference circuit 100 and the third switch S3; in the present embodiment, the Schmitt trigger 108 is disposed between the output terminal of the comparator 104 and the input terminal of the control logic circuit 106 for noise reduction.

Figure 3:
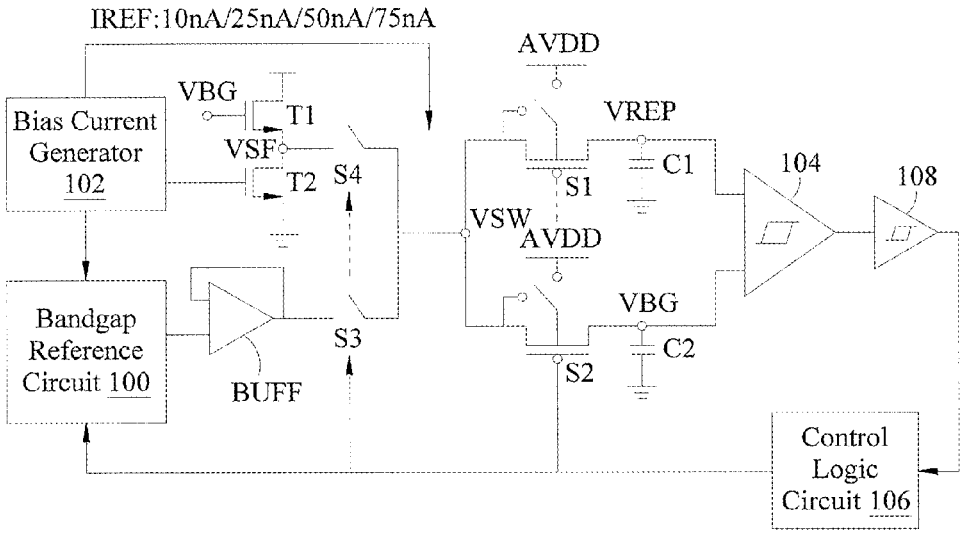
FIG. 3 is the schematic diagram illustrating the circuit layout of the reference voltage circuit according to the third embodiment of the present disclosure.

FIG. 3 is the schematic diagram illustrating the circuit layout of the reference voltage circuit according to the third embodiment of the present disclosure. As indicated above, the average power consumption of the overall circuit reduces as the ratio of the duration the bandgap reference circuit 100 stays on to the duration the bandgap reference circuit 100 stays off increases. So, in order to extend the duration the bandgap reference circuit 100 is turned off, it is important to lower the rate of discharge of the first capacitor C1 and second capacitor C2. To achieve this goal, additional electronic component has to be disposed in the reference voltage circuit of the present disclosure.

First, in the third embodiment, the electric potential VSF at the other terminal of the first switch S1 and second switch S2 not directly connected to the capacitors is approximately equivalent to the electric potential VBG at the first terminal of the second capacitor C2. A source follower is disposed in the present invention to achieve this goal. The electric potential at the input of the source follower equals to VBG while the electric potential at the output thereof equals to VBG minus Vth; as a result, the leakage current of the first switch S1 and second switch S2 can be dramatically reduced due to the reduction of the potential difference between the two terminals of the switches S1 and S2. Hence, the duration the bandgap reference circuit 100 stays off could be significantly extended.

In particular, the source follower may be disposed with a first transistor T1 and a second transistor T2. As shown in the FIG. 3, the gate electrode of the first transistor T1 is connected to the first terminal of the second capacitor C2 with electric potential VBG, whereas the drain electrode of the second transistor T2 is connected to the source electrode of the first transistor T1, the gate electrode and source electrode of the second transistor T2 are respectively connected to the bias current generator 102 and ground terminal GND. The electric potentials at drain electrode of the second transistor T2 and the source electrode of the first transistor T1 are VSF. Therefore, as can be appreciated from the FIG. 3, in the low power mode, the electric potential at the left terminal of the second switch S2 equals to VBG minus Vth while the electric potential at the right terminal equals to VBG; the reduction of potential difference between the two terminals of the second switch S2 is able to reduce the discharging of the first capacitor C1 and second capacitor C2.

Besides, the first switch S1 and the second switch S2 may be formed with the P-type metal-oxide-semiconductor (PMOS); since the leakage current of the body electrode of the PMOS flows from the voltage source AVDD to the first capacitor C1 and second capacitor C2 and charges the capacitors, this phenomenon cancels out the leakage current of the first capacitor C1 and second capacitor C2 flowing respectively through the first switch S1 and the second switch S2 to points with lower electric potential. As a result, the duration the bandgap reference circuit 100 stays off is further extended. Furthermore, in the active mode, the base electrodes of the conducting first switch S1 and second switch S2 may be respectively connected to the source electrodes thereof, so as to eliminate the body effect of the PMOS, thereby further reducing the on-resistance of the first switch S1 and the second switch S2, increasing the rate of charging of the capacitors.

Figure 4:
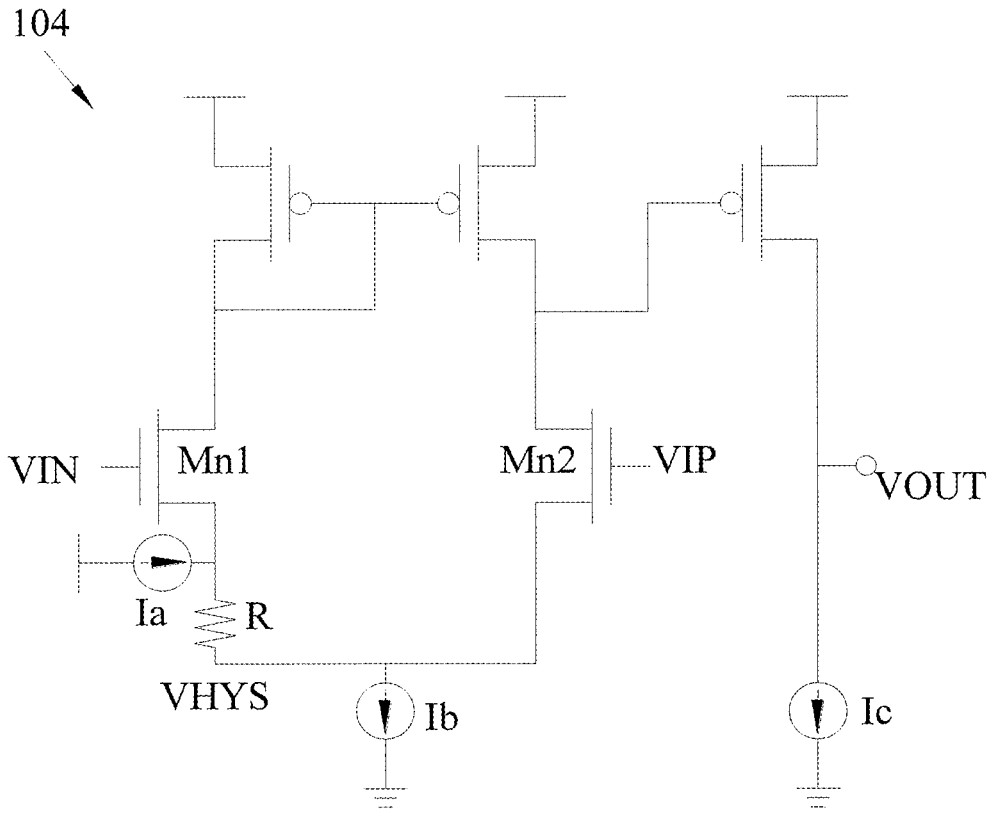
FIG. 4 is the schematic diagram illustrating the circuit layout of the embodiment of the comparator according to an embodiment of the present disclosure.

FIG. 4 is the schematic diagram illustrating the circuit layout of the embodiment of the comparator according to an embodiment of the present invention. As can be appreciated from the figure, the circuitry of the comparator 104 has low power consumption and precise hysteresis. In FIG. 4, Ia, Ib, and Ic denote the bias currents generated by the bias current generator 102 respectively, and R denotes the hysteresis resistance; the voltage entering the first input terminal VIN of the comparator 104 is configured to enter the transistor Mn1 whereas the voltage entering the second input terminal VIP is configured to enter the transistor Mn2. The hysteresis voltage of the comparator 104 is configured to be VHYS=R*(Ia+0.5Ib); since the current generated by the bias current generator 102 is related to the hysteresis resistance R, and the hysteresis voltage VHYS changes as the hysteresis resistance R changes, so the comparator 104 will in turn reduce the hysteresis resistance R after transition, i.e. reduce the hysteresis voltage VHYS. In the circumstances, the reduction of the hysteresis voltage VHYS increases the differences between the voltages VIP and Vin at both input terminals of the comparator 104 minus the hysteresis voltage VHYS, so the output stability of the comparator 104 is increased, thereby suppressing the noise interfering with the comparator 104. The hysteresis voltage VHYS may be configured using the equations as follows:

$$Q=C*V,\Delta Q=C*\Delta V,\Delta Q2=C2*\Delta VBG,\ \Delta Q1=C1*\Delta VREP,$$

$$C2*\Delta VBG=C1*\Delta VREP,\ \text{let}\ \Delta VBG=x\ \text{and}\ \Delta VREP=y,$$

$$C2*x=C1*y,y=x*C2/C1,$$

$$x-y=x-x*C2/C1=x*(1-C2/C1),$$

$$VHYS=x*(1-C2/C1)$$

Where C2=10*C1, VBG denoted the desired reference voltage, VREP denoted the reference voltage of the first capacitor C1, x is the allowed fluctuation range for the VBG. One can get the desired value of VHYS by plugging the values of x, C1 and C2 into the equations above. Generally, the rate of discharge of the first capacitor C1 and the second capacitor C2 is affected by the process drift, temperature and the voltage source AVDD. If the leakage current flows from the voltage source AVDD through the second switch S2 to charge the second capacitor C2, the reference voltage VBG at the first terminal of the second capacitor C2 will rise; on the other hand, if the second capacitor C2 discharges to the ground terminal GND, the reference voltage VBG at the second capacitor C2 will drop. Therefore, it is necessary to design a two way detection mechanism to detect the rise and drop of the voltage. So, the comparator 104 is capable of reacting to the variations between the potential differences VBG and VREP regardless of the discharge mode of the reference voltage VBG, and then transmitting the comparison signals through the output terminal VOUT; such that the control logic circuit 106 is able to control the control logic circuit 106 to turn on or turn off without error.

Figure 5:
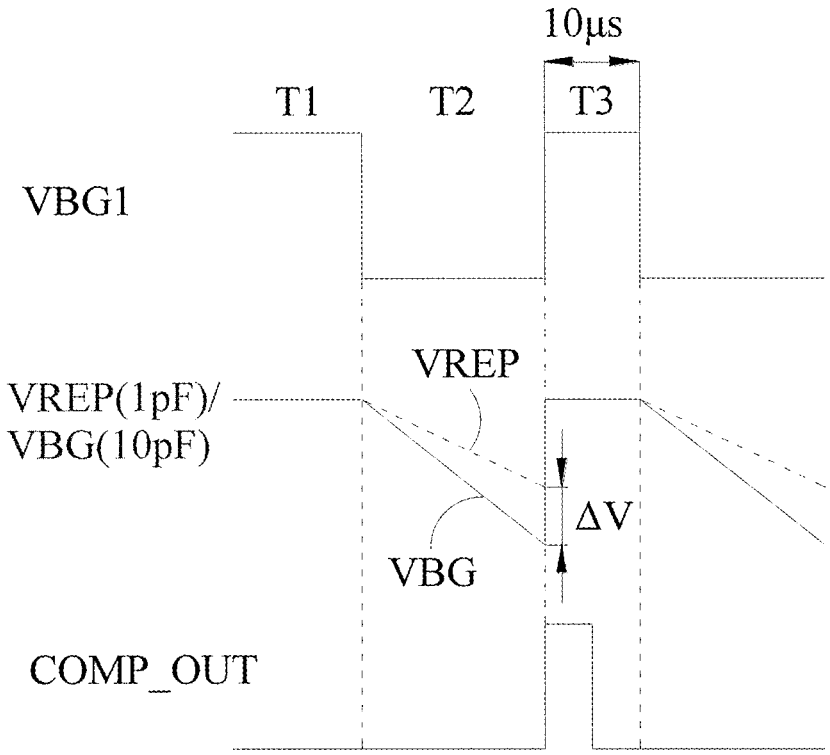
FIG. 5 is the sequence diagram illustrating the voltages of the reference voltage circuit in the active mode and the low power mode according to an embodiment of the present disclosure.
Figure 6:
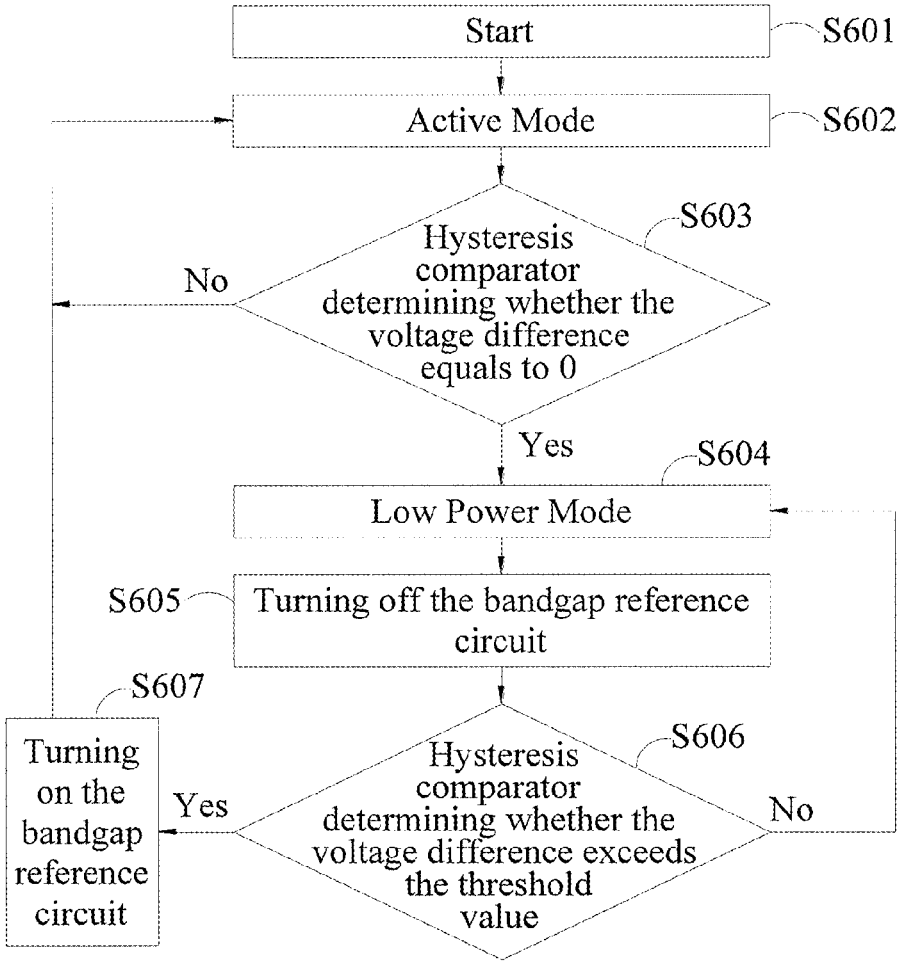
FIG. 6 is the flow chart of the reference voltage circuit according to an embodiment of the present disclosure.

FIG. 5 is the sequence diagram illustrating the voltages of the reference voltage circuit in the active mode and the low power mode whereas the FIG. 6 is the flow chart of the reference voltage circuit according to an embodiment of the present disclosure. As shown in the figure, in the Step S601, the reference voltage circuit is turned on; in the Step S602, the control logic circuit 106 is configured to enter the active mode after being initially turned on. During the T1 phase in the FIG. 5, the reference voltage circuit is in the active mode; the bandgap reference circuit 100 is turned on and delivers the bandgap reference voltage VBG1. In this embodiment, the capacitances of the first capacitor C1 and the second capacitor C2 are respectively about 1 pF and 10 pF; the bandgap reference circuit 100 charges the electric potential VREP at the first terminal of the first capacitor C1 and the electric potential VBG at the first terminal of the second capacitor C2 to the bandgap reference voltage VBG1.

In the Step S603, the comparator 104 determines whether the potential difference between the electric potential VREP at the first terminal of the first capacitor C1 and the electric potential VBG at the first terminal of the second capacitor C2 equals to 0. If the potential difference is not equal to 0, the system goes back to the Step S602. In the Step S604, if the potential difference equals to 0, the comparator 104 transmits the first comparison signal and the control logic circuit 106 enters the low power mode. For Step S605, the bandgap reference circuit 100 is turned off so the delivery of bandgap reference voltage VBG1 is stopped.

Meanwhile, as illustrated in the T2 phase in the FIG. 5, the first switch S1 and the second switch S2 are turned off and the first capacitor C1 and the second capacitor C2 start discharging; therefore, both the electric potential VREP at the first terminal of the first capacitor C1 and the electric potential VBG at the first terminal of the second capacitor C2 start to drop. However, as the capacitors C1 and C2 have different capacitance but equal discharge current, the electric potential VBG will drop slower than the electric potential VREP. Step S606, the comparator 104 determines whether the potential difference exceeds the threshold value, i.e. the hysteresis voltage VHYS of the comparator 104. If the difference ΔV between the electric potentials VBG and VREP does not exceed the threshold value of the comparator 104, the present invention goes back to Step S604. For Step S607, if the difference between the electric potentials VBG and VREP exceeds the threshold value of the comparator 104, the voltage level COMP_OUT of the comparator 104 is raised and the second comparison signal is transmitted. The control logic circuit 106 having received the second comparison signal, controls the bandgap reference circuit 100 to turn on and the present invention goes back to Step S602 and enters the active mode. Step S607 is represented by the T3 phase in the FIG. 5; as shown in the figure, the bandgap reference circuit 100 resumes the delivery of bandgap reference voltage VBG1 to respectively recharge the electric potentials VREP and VBG at the first capacitor C1 and second capacitor C2. The comparator 104 of the reference voltage circuit of the present disclosure will then repeat the Step S603 to determine whether the difference ΔV between the electric potentials VBG and VREP equals to 0, if so, the reference voltage circuit performs Step S604 and enters the low power mode so the bandgap reference circuit 100 is turned off.

According to the above mentioned configuration, by precisely manipulating the capacitance or the charging/discharging current of the first capacitor C1 and second capacitor C2, the first switch S1 and second switch S2 of the reference voltage circuit can be controlled to periodically switch between the ON and OFF state as well as control the bandgap reference circuit 100 to periodically deliver the bandgap reference voltage VBG1. Therefore, with the configuration of the present invention, the logic signal controlling the first switch S1 and second switch S2 has the features of a clock or a pulse signal.

Figure 7:
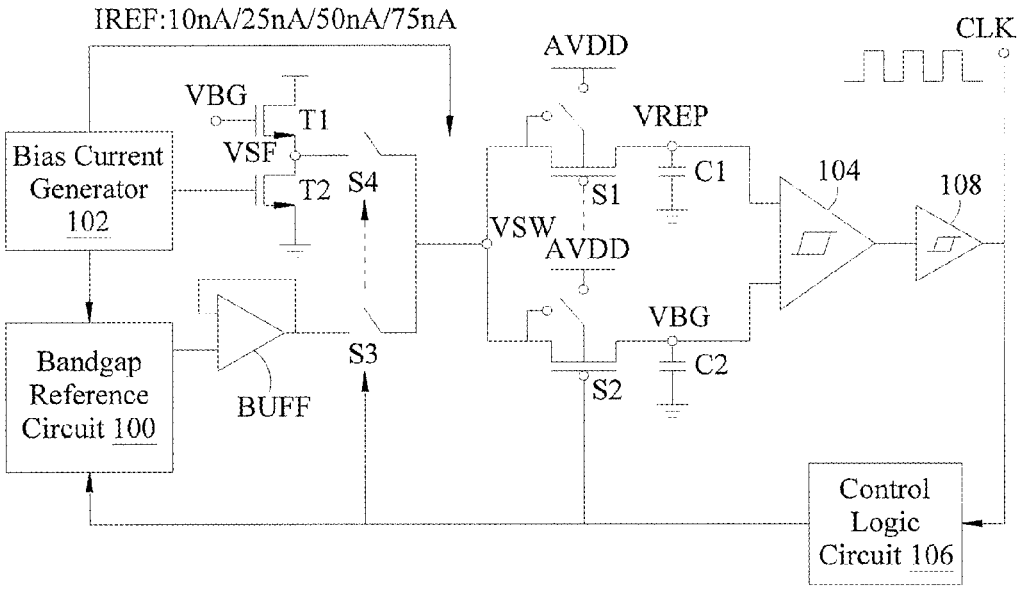
FIG. 7 is the schematic diagram illustrating the circuit layout of the clock generating circuit according to an embodiment of the present disclosure.

FIG. 7 is the schematic diagram illustrating the circuit layout of the pulse signal generator circuit according to an embodiment of the present disclosure. As can be appreciated in the figure and the Equation (1), the embodiment of the present disclosure can be configured in such a way that the rate of voltage drop in the first capacitor C1 is faster than that of the second capacitor C2, together with the configuration of the hysteresis voltage of the comparator 104, the difference between the electric potentials VBG and VREP can be determined, if the potential difference between VBG and VREP exceeds the threshold value, the comparator 104 transmits high voltage level signal and turns on the bandgap reference circuit 100 to deliver bandgap reference voltage VBG1 to the first capacitor C1 and second capacitor C2 for recharging; if the electric potential VREP of the first capacitor C1 equals to the electric potential VBG of the second capacitor C2, the comparator 104 transmits low voltage level signal. As a result, the pulse signal alternating between high level and low level which controls the first switch S1 and second switch S2 to switch between on and off state can serve as a clocking signal CLK; therefore the present disclosure may be implemented as a pulse signal generator with ultra-low power consumption.

In summary, the reference voltage circuit of the present disclosure is able to store the high precision bandgap reference voltage generated from the bandgap reference circuit to the capacitors. Then, the reference voltage circuit of the present disclosure is configured to recharge the capacitors via effective control mechanism, i.e. turning on or off the bandgap reference circuit, so as to ensure that the reference voltage stored in the capacitors is consistent with the bandgap reference voltage generated by the bandgap reference circuit. The control mechanism may be automatically adjusted according to the variation of temperature, process and voltage. Henceforth, a bandgap reference circuit with high precision and low power consumption can be attained.

Besides, the reference voltage circuit of the present disclosure is capable of detecting the amount of the reference voltage offset with the help of the comparator; if the reference voltage offset exceeds the threshold value, the present invention is configured to restart the bandgap reference circuit to recharge the reference voltage inside the capacitors so as to preserve the quality of the reference voltage.

What is claimed is:

1. A reference voltage circuit, comprising:

a bandgap reference circuit delivering a bandgap reference voltage and connected to a first switch and a second switch;

a bias current generator connected to the bandgap reference circuit;

a first capacitor connected between the first switch and a ground terminal;

a second capacitor connected between the second switch and another ground terminal;

a comparator having a first input terminal and a second input terminal respectively connected to the first capacitor and the second capacitor to compare a potential difference between the first capacitor and the second capacitor, wherein the bias current generator is connected to a power supply terminal of the comparator; and a control logic circuit connected between the comparator and the first switch and connected between the second switch and the bandgap reference circuit, wherein, in an active mode of the control logic circuit, the control logic circuit controls the first switch and the second switch to turn on, and controls the bandgap reference circuit to deliver the bandgap reference voltage to charge the first capacitor and the second capacitor, when voltages in the first capacitor and the second capacitor reach the bandgap reference voltage, the comparator transmits a first comparison signal to the control logic circuit, such that the control logic circuit enters a low power mode; in the low power mode, the control logic circuit controls the first switch and the second switch to turn off, and controls the bandgap reference circuit to stop delivering the bandgap reference voltage, then, the first capacitor and the second capacitor start discharging, when the potential difference between the first capacitor and the second capacitor is larger than a threshold value of the comparator, the comparator transmits a second comparison signal, the control logic circuit returns to the active mode according to the second comparison signal; wherein a rate of voltage change of the first capacitor and the second capacitor is not equal during charging and discharging.

2. The reference voltage circuit of claim 1, further comprising a third switch connected between the bandgap reference circuit and both the first and second switches; wherein the control logic circuit is connected to the third switch and controls the third switch; wherein in the active mode, the control logic circuit controls the third switch to turn on according to the first comparison signal; wherein in the low power mode, the control logic circuit controls the third switch to turn off according to the second comparison signal.

3. The reference voltage circuit of claim 2, further comprising a fourth switch connected between the bias current generator and both the first and the second switches, wherein, the control logic circuit is connected to the fourth switch and controls the fourth switch, wherein, in the active mode, the control logic circuit controls the fourth switch to turn off according to the first comparison signal; wherein, in the low power mode, the control logic circuit controls the fourth switch to turn on according to the second comparison signal.

4. The reference voltage circuit of claim 3, further comprising a source follower connected between the fourth switch and the bias current generator, wherein a first input terminal of the source follower is connected to the second capacitor while a second input terminal of the source follower is connected to the bias current generator in order to reduce the leakage current passing through the first switch and the second switch in the low power mode.

5. The reference voltage circuit of claim 1, wherein the first switch is a first transistor, in the active mode, the control logic circuit controls a body electrode of the first transistor to selectively connect to a source electrode of the first transistor according to the first comparison signal, in the low power mode, the control logic circuit controls the body electrode of the first transistor to selectively connect to a voltage source according to the second comparison signal.

6. The reference voltage circuit of claim 1, wherein the second switch is a second transistor, in the active mode, the control logic circuit controls a body electrode of the second transistor to selectively connect to a source electrode of the second transistor according to the first comparison signal, in the low power mode, the control logic circuit controls the body electrode of the second transistor to selectively connect to the voltage source according to the second comparison signal.

7. The reference voltage circuit of claim 1, further comprising a buffer connected between the bandgap reference circuit and a third switch.

8. The reference voltage circuit of claim 1, further comprising a Schmitt trigger disposed between an output terminal of the comparator and an input terminal of the control logic circuit.

9. The reference voltage circuit of claim 1, wherein a rate of discharge of the first capacitor is not equal to a rate of discharge of the second capacitor.

10. The reference voltage circuit of claim 9, wherein a capacitance of the first capacitor is equal to a capacitance of the second capacitor, but a current flowing into or flowing out of the first capacitor is not equal to a current flowing into or flowing out of the second capacitor.

11. The reference voltage circuit of claim 9, wherein a capacitance of the first capacitor is not equal to a capacitance of the second capacitor while a current flowing into or flowing out of the first capacitor is not equal to a current flowing into or flowing out of the second capacitor.

* * * * *